US005246226A

United States Patent [19]

McGuinn

[11] Patent Number: 5,246,226

[45] Date of Patent: Sep. 21, 1993

[54] TETHERED BALL BATTING PRACTICE APPARATUS

[76] Inventor: Danny L. McGuinn, 1786 SW. Armstrong Ct., Chehalis, Wash. 98532

[21] Appl. No.: 991,301

[22] Filed: Dec. 15, 1992

[51] Int. Cl.[5] ..... A63B 69/40

[52] U.S. Cl. ..... 273/26 E; 273/29 A; 273/413

[58] Field of Search ..... 273/26 E, 26 R, 58 C, 273/29 A, 413

[56] References Cited

U.S. PATENT DOCUMENTS 824,560 6/1906 Martin ..... 273/413

2,976,040 3/1961 Bales ..... 273/26 E 3,006,647 10/1961 Haskett ..... 273/26 E 4,050,694 9/1977 Domroski ..... 273/26 E

*Primary Examiner*—Theatrice Brown

*Attorney, Agent, or Firm*—Christensen, O'Connor, Johnson & Kindness

[57] ABSTRACT

A batting tee 10 is disclosed including a ball 12 supported for orbiting in a substantially vertical plane when struck by a bat. The tee 10 includes a stand 16 supported upright upon a base 14. An arm 40 is connected to the stand and includes a ball hanger 20 that couples the ball to the arm for orbital motion in the substantially vertical plane.

6 Claims, 5 Drawing Sheets

TETHERED BALL BATTING PRACTICE APPARATUS

FIELD OF THE INVENTION

This invention relates generally to baseball or softball training equipment and, more particularly, to such equipment for use in batting instruction.

BACKGROUND OF THE INVENTION

Various skills are required to play baseball and softball. One such skill is the ability to hit a ball with a bat. Effective batting requires good hand-and-eye coordination to achieve the proper contact between bat and ball, and good technique to achieve the desired hitting power. Both of these elements are typically improved with practice.

Batting practice often involves the use of a pitcher or pitching machine to throw balls to the batter. For inexperienced batters, however, the variables encountered in the speed, path, and rotation of the pitch may be difficult to surmount initially. As a result, batting tees have been developed to support the ball in a stationary position, allowing the batter to concentrate on technique without worrying about the vagaries of a particular pitch. This arrangement can be particularly successful in developing confidence in young batters.

A conventional batting tee is a substantially cylindrical post having a lower end designed to be driven into the ground and an upper end that is cupped to support the ball. The post is flexible to avoid damage in the event the post is struck by the batter during practice. To begin practice, the batter sets a ball on the tee and then steps into a batter's box adjacent the tee. The batter then swings the bat to hit the ball off of the tee. The process is then repeated until the batter is done practicing.

There are several disadvantages with such conventional batting tees. First, either a large supply of balls is required, or the balls must be retrieved periodically for batting practice to continue. Second, unless some form of backstop is employed, batting practice using conventional tees typically must occur outdoors. Finally, it is believed that the design of conventional batting tees, including, for example, the way in which the ball is supported, hampers their effectiveness in teaching proper batting technique.

In view of these observations, it would be desirable to provide a baseball tee that does not require a ball to be repositioned after each hit, that can be used indoors, and that provides more effective training.

SUMMARY OF THE INVENTION

In accordance with this invention, a batting tee is disclosed for use with a bat. The tee includes a base and a stand extending upwardly from the base. An arm extends outwardly from the stand and a ball is coupled to the arm by an orbiting device which allows the ball to orbit around the arm when the ball is hit by the bat. An adjustment element may also be included to adjust the position of the arm relative to the stand.

In accordance with a more detailed aspect of the invention, a batting tee is disclosed for use by a batter, having a strike zone defined relative thereto, and a batting instructor. The batting tee is employed to practice the use of a bat. The tee includes a base, having a substantially planar lower surface, which is of suitable dimension and mass to support the batting tee in an upright position. An elongate stand is attached perpendicular to the base and extends at least some predetermined height above the strike zone of batters for whom the tee is designed. The stand is sufficiently rigid to exhibit limited flexure in use. An elongate arm, having a length at least equal to that of bats the length of which the tee is designed, is connected to the stand by an adjustable connector at some point above the strike zone of batters for whom the tee is designed. A handle arrangement, including two handles extending at right angles to each other, is coupled to the stand and the arm at the connector. The handles are designed to be grasped by the batting instructor to limit motion of the stand and the arm during practice. An elongate ball hanger includes a first end pivotably coupled to the arm for free rotation of the hanger about the arm. The hanger is dimensioned to support a second end in the strike zone of batters for whom the tee is designed. Finally, a ball is secured to the second end of the ball hanger for substantially orbital rotation about the arm when the ball is struck by a bat.

In accordance with yet another aspect of the invention, a method is disclosed for use by an instructor and a pupil in practicing the use of a bat to hit a ball. The method includes the steps of affixing the ball to a support so that the ball orbits in a substantially vertical plane when hit by the bat. The support is adjusted so that the ball rests within the strike zone of the pupil. Also, handles are provided for use by the instructor to brace the support and limit the motion of the support in at least two dimensions.

BRIEF DESCRIPTION OF THE DRAWINGS

The foregoing aspects and many of the attendant advantages of this invention will become more readily appreciated by reference to the following detailed description, when taken in conjunction with the accompanying drawings.

DETAILED DESCRIPTION OF THE PREFERRED EMBODIMENT

Figure 1:
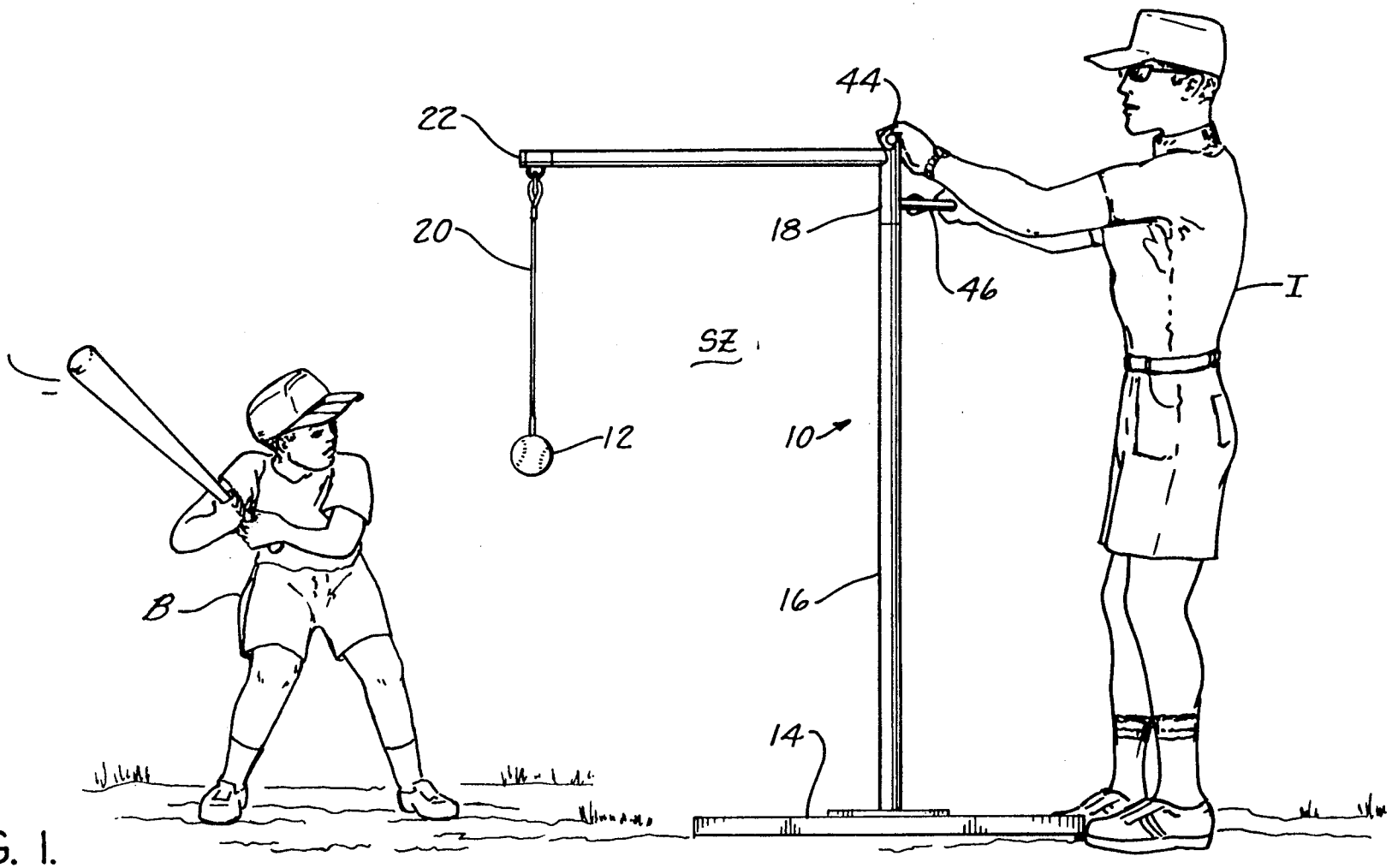
FIG. 1 illustrates a batting tee constructed in accordance with this invention in use by a batting instructor and batter.

Referring now to FIG. 1, an orbital batting tee 10, constructed in accordance with this invention, is shown. As illustrated, the batting tee 10 includes a ball 12 that is supported in the strike zone SZ of a batter B. Although not mandatory, the batting tee 10 is preferably further supported and stabilized by an instructor I positioned next to the batting tee 10. When the batter B strikes ball 12 with the bat, the ball 12 is free to orbit in a substantially vertical plane before returning to the strike zone SZ for the next swing.

As will be described in greater detail below, the orbital batting tee 10 does not require the ball to be replaced after each swing. Further, because the ball is controlled after being hit, it can be used indoors. In addition, the batting tee 10 is easily portable, but provides the stability necessary for safe and proper use. Finally, the orbital batting tee 10 has been found to provide superior training results with young batters.

Turning now to a more detailed discussion of the construction of orbital tee 10, reference is again made to FIG. 1. As shown, the primary components of tee 10 are a base 14; stand 16; adjustable arm, connector, and handle assembly 18; ball hanger 20; and cap 22; as well as the ball 12 mentioned above.

Figure 2:
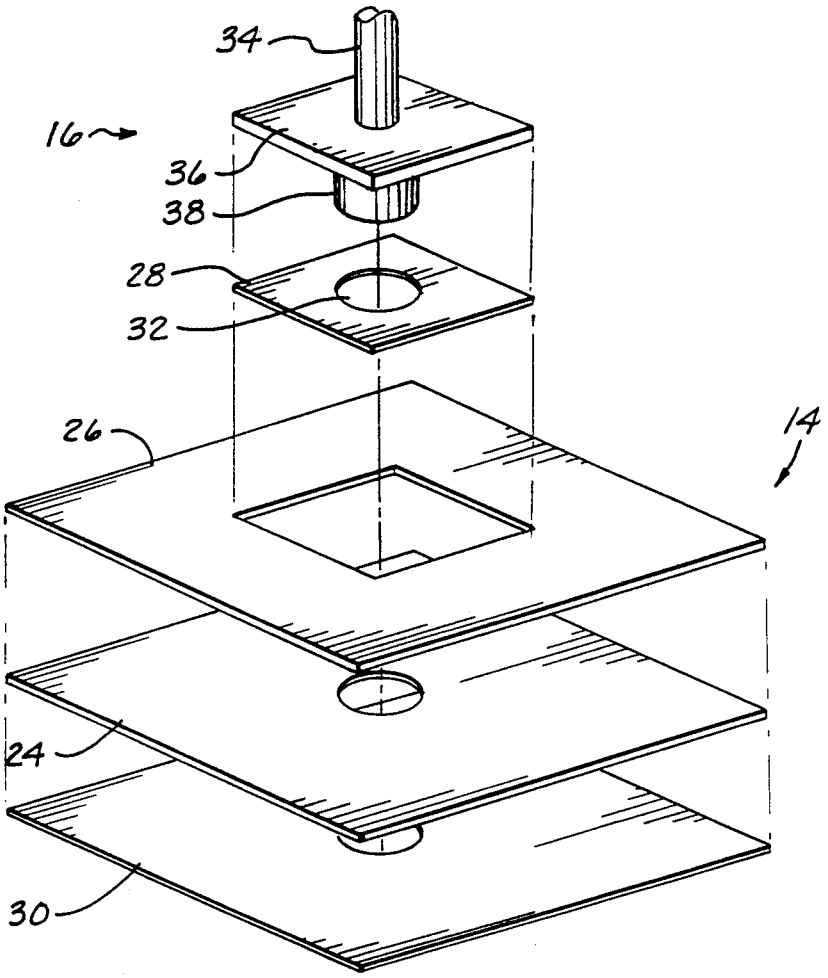
FIG. 2 is a partial exploded view of the tee of FIG. 1, illustrating various components of the tee's base.

Reviewing each of these components individually, the base 14 is shown in FIG. 2 and includes, for example, a square assembly dimensioned and constructed to stabilize and support the batting tee 10. More particularly, the base 14 includes two sheets 24 and 26 of plywood, a plastic insert 28, and a rubber backing layer 30. Sheets 24 and 26 are roughly 60 cm×60 cm×2 cm, with the top sheet 26 being provided with a square central opening that is 20 cm×20 cm and the bottom sheet 24 having a circular central opening that is 6 cm in diameter. The sheets 24 and 26 are sufficiently large and heavy to provide the requisite stability to base 14.

The plastic insert 28 is roughly 20 cm×20 cm×2 cm and is secured in the opening of sheet 26 by screws (not shown). Insert 28 includes a circular central opening that is 6 cm in diameter and that aligns with the opening provided in bottom sheet 24 to define a shaft mounting hole 32. As will be appreciated, the plastic insert 28 provides a protective guide around the mouth of hole 32, preventing the stand 16 from chipping the plywood sheets 24 and 26 during use.

The rubber backing layer 30 is roughly 0.3 cm thick and is adhered to the bottom surface of plywood sheet 24. Backing layer 30 provides the requisite traction between the base 14 and any smooth surface the tee 10 is set upon.

Figure 3:
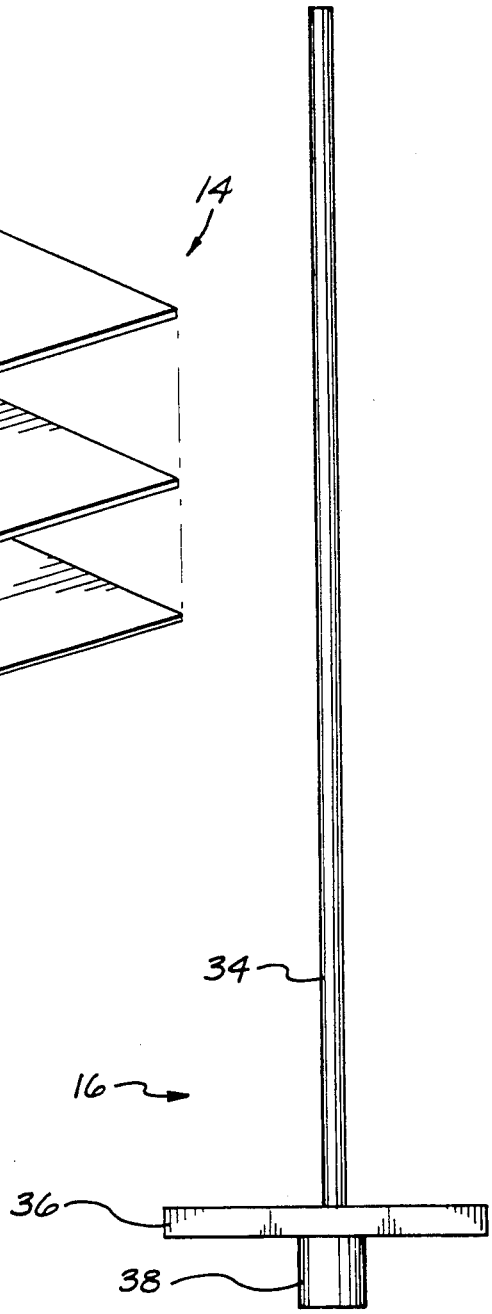
FIG. 3 is an illustration of a stand included in the tee of FIG. 1.

As shown in FIGS. 2 and 3, the stand 16 includes a body 34, plate 36, and post 38. The body 34 is the major structural component of stand 16 and is preferably a piece of stainless steel pipe that is 2 cm thick and roughly 152 cm long. Body 34 extends perpendicularly from, and is welded to, a support plate 36. The support plate 36 is a sheet of mild steel that is roughly 20 cm×20 cm×0.3 cm and abuts the plastic insert 28 to provide lateral support to the stand 16 when attached to base 14. The post 38 is a piece of stainless steel pipe having an outer diameter of roughly 6 cm and a length of 4 cm, corresponding to the thickness of base 14. The post 38 is welded to the bottom of plate 36 and is designed to be received within the mounting hole 32 provided in base 14.

Figure 4:
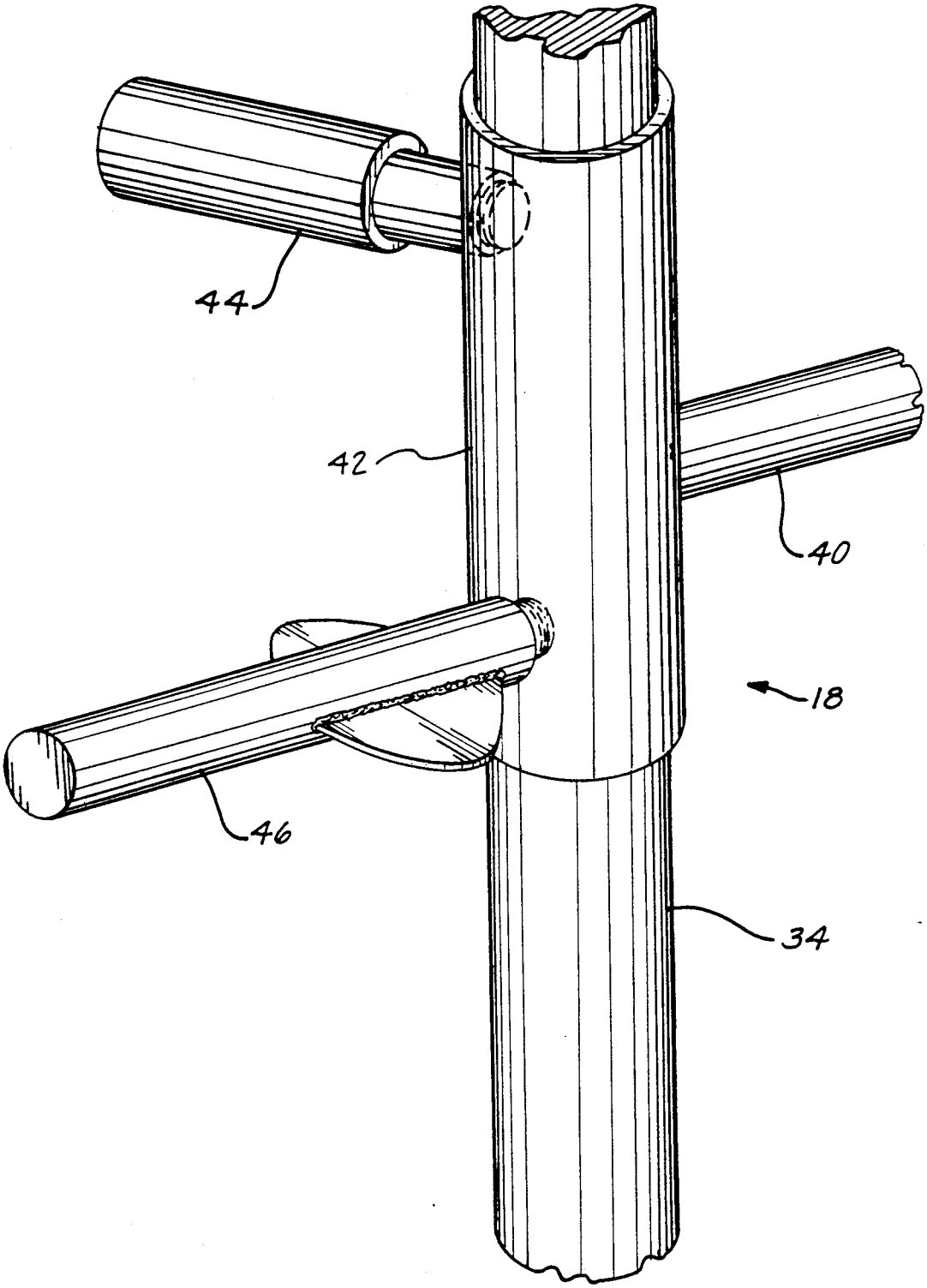
FIG. 4 illustrates a portion of an adjustable arm assembly shown in FIG. 1 and coupled to the stand of FIG. 3.

As shown in FIG. 4, the arm, connector, and handle assembly 18 includes several different components. In a preferred arrangement, an arm 40 is provided in the form of a 56 cm long piece of stainless steel pipe that is roughly 1.3 cm in diameter. An open cylindrical collar 42, having a length of roughly 10 cm and a diameter of roughly 2.5 cm, is welded perpendicularly to one end of the arm 40.

A pair of rubber-coated, stainless steel handles 44 and 46, roughly 15 cm long and 2 cm in diameter, are attached to the collar 42. In that regard, handle 44 is threaded into the collar 42 at a point slightly above, and roughly 90° from, the intersection of collar 42 and arm 40. The second handle 46 is threaded into the collar 42 at a point below, and roughly 180° from, the intersections of arm 40 and handle 44 with collar 42.

The ends of handles 44 and 46 are threaded a sufficient distance to allow the ends to project from the inner surface of collar 42 and securely engage the body 34 of stand 16 when the handles 44 and 46 are rotated all the way in. By loosening the handles 44 and 46, the threaded ends are withdrawn from the inner surface of collar 42, allowing the relative position of the assembly 18 and stand 16 to be adjusted. Then, with the desired relative alignment achieved, the handles 44 and 46 can be tightened, locking assembly 18 in position.

Figure 5:
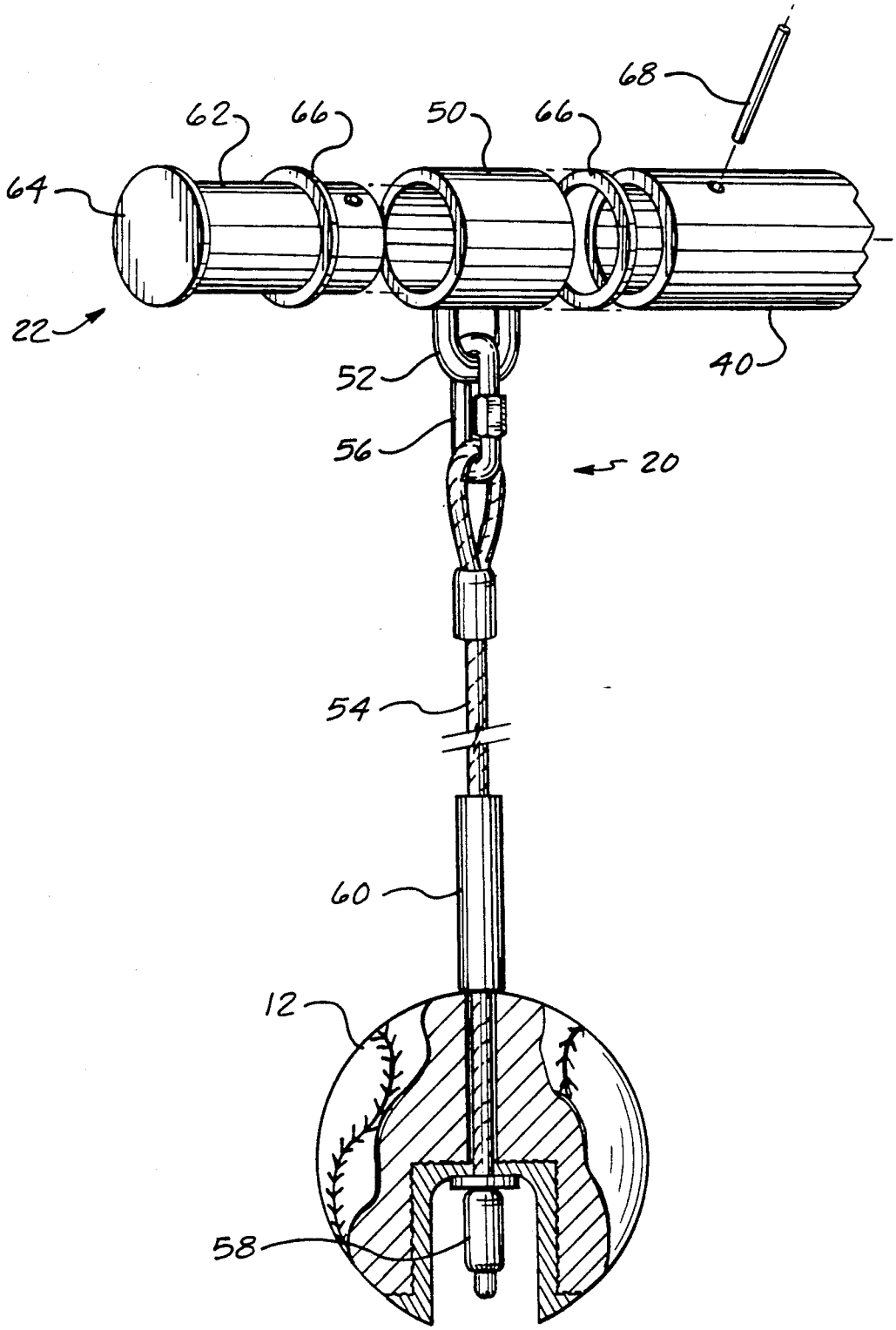
FIG. 5 illustrates a ball hanger 20, cap 22, and ball 12 used in the tee of FIG. 1.

As shown in FIG. 5, the ball hanger 20 includes a collar 50 formed of stainless steel pipe that is roughly 3.8 cm long and 1.3 cm in diameter. A 0.6 cm thick piece of stainless steel round stock is bent to form a loop 52 that is welded to the collar 50 at both ends. One end of a 0.3 cm vinyl-coated, stainless steel cable 54 is attached to loop 52 by a locking ring 56. The other end of the cable 54 is secured to ball 12, for example, by passing the cable 54 through an aperture extending through ball 12 and providing the end of the cable with a cleat 58. A piece of tubing 60, fitted snugly over cable 54, restricts the ball from moving up the cable 54 in use.

Finally, the cap 22 includes a body 62 and head 64. The body 62 is designed to be partially received within the open end of arm 40 after passing through collar 50, allowing collar 50 to rotate freely thereabouts. The head 64 of the cap 22 is of slightly greater diameter than body 62, and prevents collar 50 from coming loose during use. Nylon washers 66 are provided on each side of the collar 50, between the arm 40 and head 64, to ensure smooth rotation of collar 50 about the body 62. A pin 68 locks the cap 22 onto the arm 40.

A batting tee 10 of the type described above is used in the following manner. The batting instructor first sets up the batting tee 10 in the practice area. Because the tee 10 is lightweight, portable, does not allow unrestricted travel of ball 12, and offers auxiliary support from the instructor, it can be used in virtually any environment. As part of the set-up process, the instructor adjusts the position of collar 42 relative to stand 16 so that the ball 12 hangs in the desired region of the strike zone of the particular batter involved. The batting instructor then grasps the handles 44 and 46, which, by virtue of their perpendicular, staggered alignment, allow the instructor to restrict motion of the arm 40 and stand 16 in the two horizontal dimensions, as well as the vertical dimension. The batter then steps into the batting box and swings at the ball. Upon contact, the tethered ball 12 orbits arm 40 before ultimately returning to its initial position hanging vertically below collar 50. It is believed that batting practice employing a freely supported ball and orbital motion of the ball in a substantially vertical plane provides superior training results for the young batter.

Figure 6:
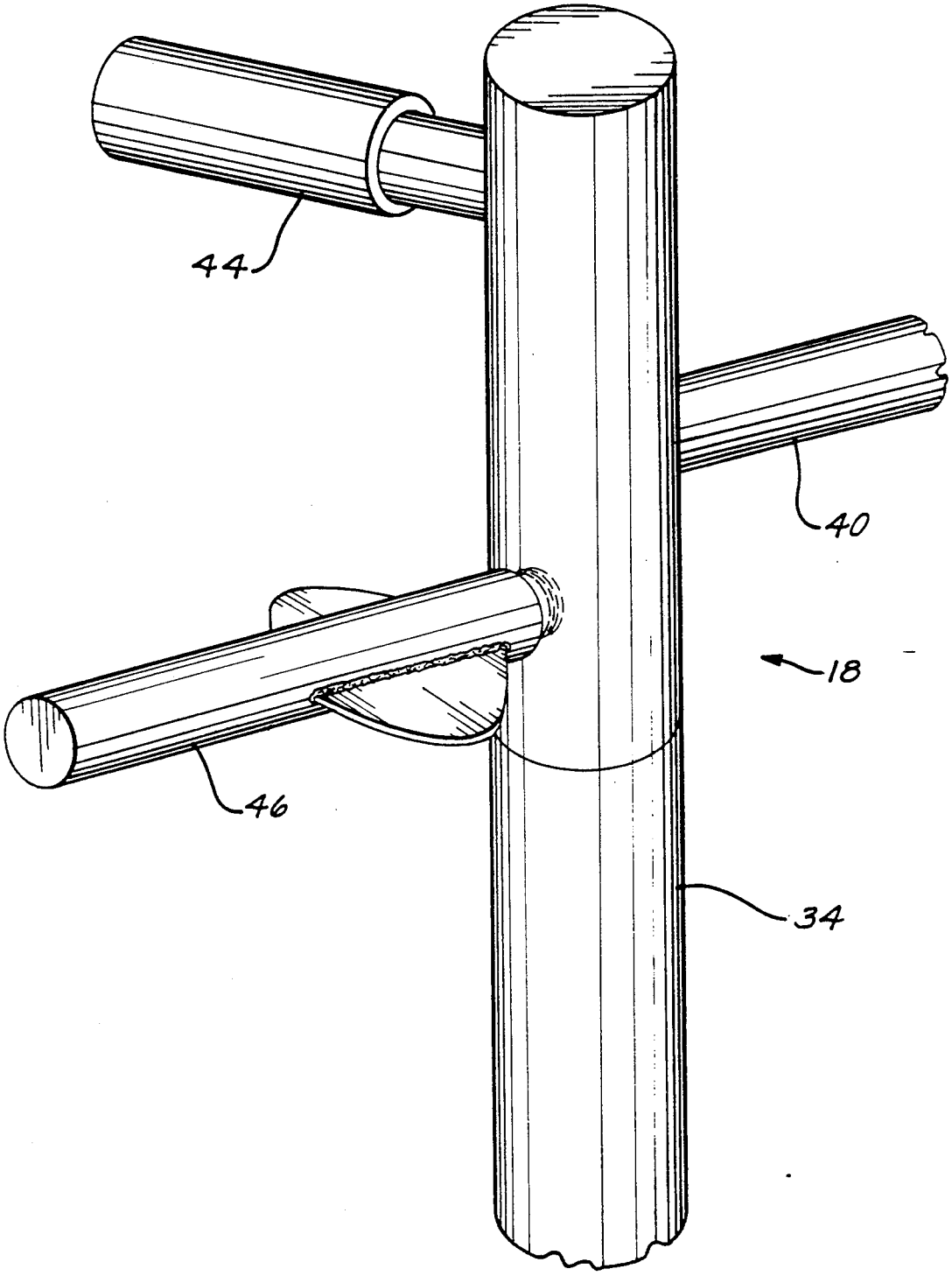
FIG. 6 illustrates a portion of an alternative, nonadjustable arm assembly.

As will be appreciated, a number of alternative configurations of the tee 10 can be employed. For example, various alternative arrangements can be used to attach the arm 40 to the stand 16 and the stand 16 to the base 14. In that regard, a nonadjustable assembly 18 may be employed that is either permanently or removably attached to the stand at a fixed vertical position as shown in FIG. 6. The arrangement shown is identical to that of FIG. 4, with the exception that the collar 42 is welded to body 34 and handles 44 and 46 are welded to collar 42. Also, the base can be provided with some form of spikes to support the batting tee when used it is used on the ground.

While the preferred embodiment of the invention has been illustrated and described, it will be appreciated that various changes can be made therein without departing from the spirit and scope of the invention. Obviously, other materials may be selected as desired and other mechanisms for securing the pieces together, as well as providing the desired adjustability and rotation of components may be employed.

The embodiments of the invention in which an exclusive property or privilege is claimed are defined as follows:

1. A tethered ball batting practice apparatus comprising:

(a) a plainer base;

(b) an elongate stand supported on said base at one of its ends, said stand extending substantially vertical and being substantially rigid;

(c) an elongate arm;

(d) a connector coaxially mounted on said stand for adjustably connecting said arm to said stand;

(e) a handle arrangement including two handles coupled to said connector at right angles to each other and said arm, said handles being designed to be grasped by a batting instructor for stabilizing said stand and said arm during practice;

(f) an elongate ball hanger, having a first end and a second end, pivot means coupling said first end to said arm for free rotation of said hanger about said arm, said hanger being dimensioned to support said second end above an apparatus support surface; and (g) a ball secured to said second end of said hanger for orbital rotation about said arm when said ball is struck by a bat.

2. The batting practice apparatus of claim 1, wherein said stand includes a plate mounted perpendicular to said one end.

3. The batting practice apparatus of claim 3, further comprising at least one connector attaching said plate to said base.

4. The batting practice apparatus of claim 1, wherein said stand, said arm, and said pivot means each comprises stainless steel pipe.

5. The batting practice apparatus of claim 1, wherein said elongated adjustable connector is a cylindrical sleeve, slidably mounted on said stand to allow said arm to slide upwardly and downwardly on the stand, said arm being coupled to said sleeve substantially perpendicular to the axis of said sleeve.

6. The batting practice apparatus of claim 5, wherein said handle arrangement further includes locking means coupled to said sleeve for locking said arm in place on said stand and preventing said arm from rotating relative to said stand.

* * * * *